US006700292B2

(12) United States Patent
Otani et al.

(10) Patent No.: US 6,700,292 B2
(45) Date of Patent: Mar. 2, 2004

(54) METAL-GRAPHITE BRUSH

(75) Inventors: Takayoshi Otani, Mie (JP); Mitsuo Ikeda, Mie (JP); Yoichi Sakaura, Mie (JP); Takahiro Sakamoto, Mie (JP); Youichi Murakami, Aichi (JP); Kyoji Inukai, Toyota (JP); Yasuyuki Wakahara, Kariya (JP); Masami Niimi, Handa (JP)

(73) Assignees: Tris Inc. (JP); Denso Corporation (JP)

( * ) Notice: Subject to any disclaimer, the term of this patent is extended or adjusted under 35 U.S.C. 154(b) by 44 days.

(21) Appl. No.: 10/279,655

(22) Filed: Oct. 24, 2002

(65) Prior Publication Data

US 2003/0107294 A1 Jun. 12, 2003

(30) Foreign Application Priority Data

Oct. 25, 2001 (JP) ..... 2001-327535

(51) Int. Cl.[7] ..... H01R 39/18

(52) U.S. Cl. ..... 310/248; 310/248; 310/233; 310/251; 310/253

(58) Field of Search ..... 310/248–253

(56) References Cited

U.S. PATENT DOCUMENTS 5,168,620 A * 12/1992 Denney et al. ..... 29/597
5,270,504 A 12/1993 Grohs et al.

FOREIGN PATENT DOCUMENTS

JP 08-137748 5/1996
JP 08137748 * 5/1996 ..... G02F/1/1337
JP 2000-144202 A 5/2000

* cited by examiner

*Primary Examiner*—Karl Tamai
*Assistant Examiner*—Iraj A. Mohandesi
(74) *Attorney, Agent, or Firm*—Webb Ziesenheim Logsdon Orkin & Hanson, P.C.

(57) ABSTRACT

A metal-graphite brush has a copper-graphite brush body to which a metal sulfide solid lubricant is added and a lead embedded. Indium is at least added to an interface between the brush body and the lead in a concentration of 0.4–8 wt %.

6 Claims, 3 Drawing Sheets

METAL-GRAPHITE BRUSH

FIELD OF THE INVENTION

The present invention relates to metal-graphite brushes which are used in electrical motors for automobiles, etc, and in particular, Pb-less metal-graphite brush.

PRIOR ART

Metal-graphite brushes have been used as brushes for low-voltage operation, such as brushes for electrical motors in automobiles. They are produced by mixing graphite and a metal powder such as copper powder, molding and sintering the mixture. As operated at low voltages, their resistivities are lowered by adding a low resistance metal powder. A metal sulfide solid lubricant, such as molybdenum disulfide or tungsten disulfide, and Pb are added to metal-graphite brushes in many cases. For example, in brushes for heavy load such as brushes for starting motor, Pb and a metal sulfide solid lubricant are added in most of the cases.

In recent years, Pb has been attracting greater attention as one of materials damaging to the environment, and there is a growing demand for Pb-less brushes. Of course, brushes containing no lead have been available up to the present and they have been used in some motors other than starting motors. Even some brushes for starting motors can be used by simply eliminating Pb from them, provided that they are used under normal service environments. To improve the lubricating properties without Pb, Japanese Patent Opening Hei 5-226048 (U.S. Pat. No. 5,270,504) proposes that a metal having a melting point lower than that of copper is mixed in such a way that copper and the metal do not form an alloy. The present inventors, however, found that in metal-graphite brushes wherein a metal sulfide solid lubricant is added to copper and graphite, the elimination of Pb results in an increase in the lead connection resistance under high temperature or high humidity.

SUMMARY OF THE INVENTION

The initial object of the present invention is to control the increase in the lead connection resistance of a Pb-less metal-graphite brush even under high humidity.

A secondary object of the present invention is to control, in addition to the increase in the lead connection resistance, the increase in the resistivity of the brush body under high humidity.

Another secondary object of the present invention is to control the increase in the lead connection resistance by means of a small amount of indium.

In the present invention, a metal-graphite brush comprising a copper-graphite brush body to which a metal sulfide solid lubricant is added and a lead embedded in the copper-graphite brush body is characterized in that indium is at least added to an interface between said brush body and the lead.

Preferably, indium is added in a concentration of 0.4–8 wt % substantially in all over said brush body.

Preferably, indium is added in a neighborhood of the lead in the brush body and that no indium is added in a neighborhood of a portion of the brush body with which a commutator of a rotational electric armature is to be in contact.

Preferably, an indium source is provided at least at a portion of the lead embedded in said brush body so as to supply indium to the interface between the brush body and the lead.

Preferably, the metal sulfide solid lubricant is at least a member of a group comprising molybdenum disulfide and tungsten disulfide and a concentration of the metal sulfide solid lubricant is from 1 to 5 wt %.

Preferably, the lead is a non-electroplated copper lead.

According to the experiments by the present inventors, the increase in the lead connection resistance under high humidity is attributed to the influences of the metal sulfide solid lubricant. When the metal sulfide solid lubricant was not added, the lead connection resistance did not increase substantially even under high humidity. This is related to the presence or absence of Pb. When Pb was added, the lead connection resistance hardly increased. In Pb-less brushes, in correspondence with the increase in the lead connection resistance, the copper powder and the embedded lead in the brush body showed a greater tendency to be oxidized under high humidity.

The metal sulfide solid lubricant such as molybdenum disulfide or tungsten disulfide is added by the designer of the brush, but the metal sulfide solid lubricant is indispensable to brushes so as to have a long service life. Without metal sulfide solid lubricant, an excessive wear may be generated. In particular, this phenomenon is conspicuous in starter brushes to which Pb has been added. When Pb and the metal sulfide solid lubricant are eliminated simultaneously, the service life of the brush will be reduced significantly. Hence in many cases, the metal sulfide solid lubricant can not be eliminated from Pb-less brushes.

The present inventors estimated the mechanism by which the metal sulfide solid lubricant the accelerates oxidization of the copper powder and the embedded lead under high humidity as follows: At the time of sintering the brushes, sulfur is liberated from the metal sulfide solid lubricant added to the brush and sulfur adsorbs on the surface of copper to produce copper sulfide. If moisture acts on copper sulfide under high humidity, strongly acidic copper sulfate will be produced to corrode severely the copper powder and the lead.

The mechanism by which Pb prevents the oxidization of the copper powder and the embedded lead in the brush is not known exactly. The present inventors estimate that Pb contained in the brush partially evaporates at the time of sintering and coats the surface of copper in the form of a very thin Pb layer. And this Pb layer protects the inner copper from sulfate ion, etc.

The present inventors searched for materials which can prevent, in place of Pb, the increases in the lead connection resistance and the resistivity of the brush body under high humidity. Only indium was found to be effective in preventing the increases in the lead connection resistance and the resistivity of the brush body under high humidity. According to the present invention, indium is added at least to the interface between the brush body and the lead, and the increase in the lead connection resistance in high humidity can be prevented.

According to the present invention, indium is added substantially in all over the brush body, and the increase in the resistivity of the brush body as well as the increase in the lead connection resistance can be prevented. When the indium concentration is from 0.4 to 8 wt %, the increase in the lead connection resistance and the increase in the resistivity can be reduced sufficiently.

According to the present invention, as indium is locally added in the neughborhood of the lead to be embedded, the use of indium can be held down.

Moreover, according to the present invention, as indium is fed from the lead, the use of indium can be held down.

As for the metal sulfide solid lubricant, for example, molybdenum disulfide or tungsten disulfide is used. When its addition is from 1 to 5 wt %, good lubrication can be obtained.

Prevention of oxidation caused by the metal sulfide solid lubricant is particularly significant when the non-electroplated copper lead, which is prone to oxidization, is used for the lead.

EMBODIMENT

Figure 1:
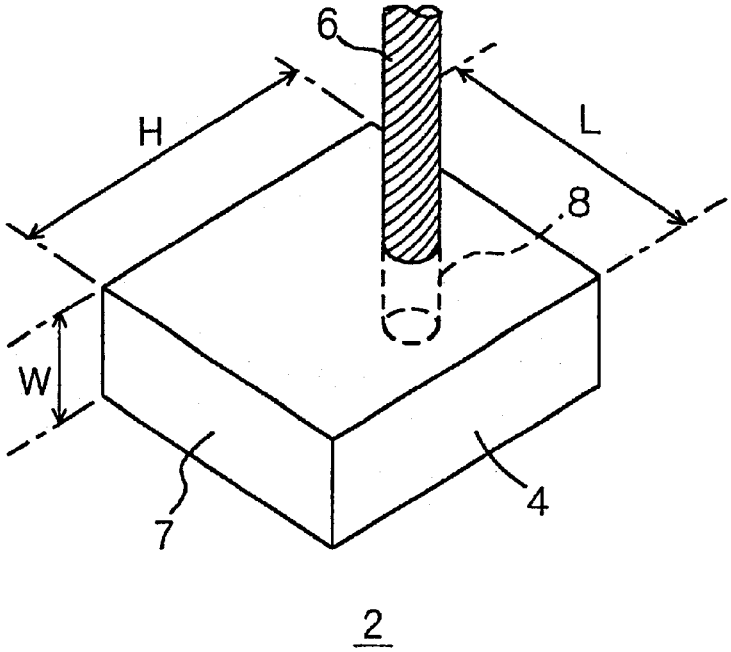
FIG. 1 is a perspective view of a metal-graphite brush of an embodiment.

FIG. 1 shows a metal-graphite brush 2 of the embodiment, and in the following, the metal-graphite brush is simply referred to as the brush. The brush is used, for example, as a brush of electrical motors in automobiles, such as a brush of a starting motor. 4 denotes a brush body, which contains graphite, copper, a metal sulfide solid lubricant and indium. 6 denotes a lead wire and the lead wire is a stranded wire or a braided wire of nonelectroplated copper wires in this embodiment, but a copper lead wire, of which wire is electroplated with nickel, etc. may be used. 7 denotes a face which contacts with the commutator of a revolving armature. 8 denotes a lead side portion. The brush 2 is produced by setting the top end of the lead wire 6 in the mixed powder, molding the mixture and sintering the molding in a reducing atmosphere or the like.

The metal sulfide solid lubricant may be, for example, molybdenum disulfide or tungsten disulfide. The addition in the brush body 4 is preferably from 1 to 5 wt %. If the addition is less than 1 wt %, the lubrication effect is not sufficient. If the addition exceeds 5 wt %, the resistivity of the brush increases. No lead is added to the brush body 4, and indium is added to it to prevent the increases in the resistivity and the lead connection resistance due to the metal sulfide solid lubricant under high humidity. The addition of indium is preferably from 0.4 to 8 wt %. If the addition is 0.3 wt %, indium has some effects in controlling the increases in the resistivity and the lead connection resistance, but to prevent them sufficiently, it is preferable to add 0.4 wt % or more. As indium is an expensive element, addition of 8 wt % or more is not economical.

It should be noted that expressions such as "no addition" or "substantially not included" indicate that the content of Pb or the content of a metal sulfide solid lubricant is not higher than the impurity level. The impurity level of Pb is 0.2 wt % or under, and the impurity level of a metal sulfide solid lubricant is 0.1 wt % or under. Indium is a rare element and its impurity level is extremely low. Indium is added, in principle, in the form of metal powder. Partially oxidized indium powder may be used. The addition is defined by reduced amount of metal.

Figure 2:
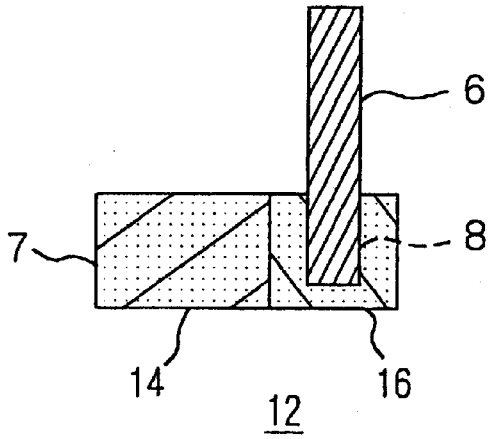
FIG. 2 is a sectional view of a metal-graphite brush of a modification.

FIG. 2 shows a brush 12 of a modification. In this brush 12, indium, being a precious element, is added only near the portion 8 adjacent to the lead wire 6, and no indium is added to the face 7 which contacts with the commutator. Thus, the amount of indium used is reduced. In this brush 12, the increase in the lead connection resistance under high humidity can be prevented. In FIG. 2, 14 denotes a commutator side portion, which comprises copper, graphite and a metal sulfide solid lubricant. 16 denotes a lead side portion into which the lead wire is embedded, and the lead side portion comprises copper, graphite and indium, or copper, graphite, indium and a metal sulfide solid lubricant. Even if the metal sulfide solid lubricant is not added to the lead side portion 16, sulfate ion or the like comes from the commutator side portion 14, and the metal sulfide solid lubricant at the impurity level in the lead side portion 16 has some effects. Accordingly, the addition of indium is needed.

Indium is added at least near the portion 8 adjacent to the lead wire 6. For example, a metal-graphite powder, to which indium is added, is made to adhere to the top end of a lead wire. Then this lead wire is set in the brush material to which no indium is added, and the brush material and the lead wire are subjected to molding. In such a case, the boundary between a portion with indium and a portion without indium will not be clear. Hence indium concentration in the brush material near the interface between the lead wire 6 and the brush body is defined as the indium concentration at the lead side portion. The description of the brush 2 in FIG. 1 also applies to the brush 12 of FIG. 2, if not specified otherwise, and the indium concentration in the lead side portion 16 is preferably from 0.4 to 8 wt %.

Figure 3:
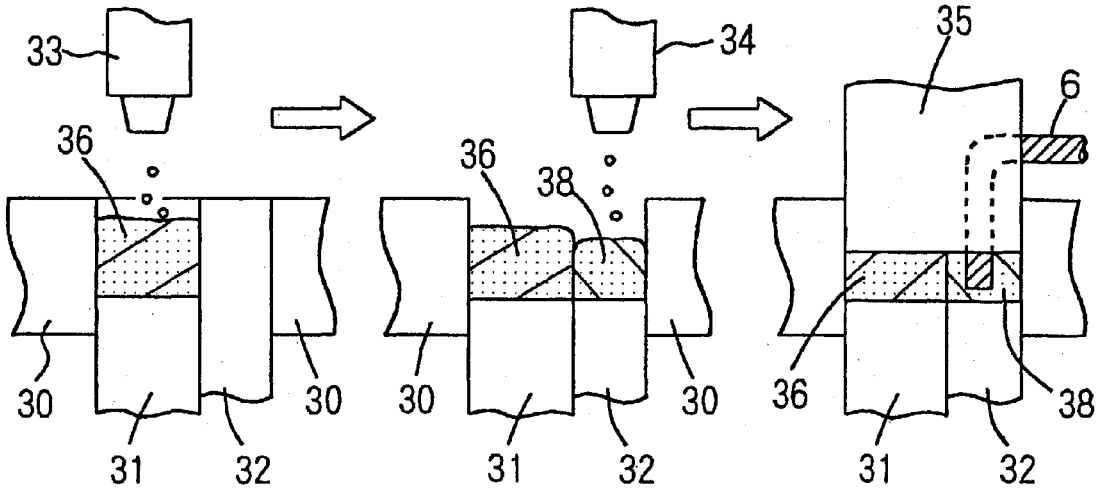
FIG. 3 shows schematically the molding process of the metal-graphite brush of the modification.

The brush 12 of FIG. 2 is produced, for example, as shown in FIG. 3. A fixed die 30 is provided, for example, a pair of lower movable dies 31, 32. A portion corresponding to the lead side portion is first blocked by the lower movable die 32. Then an indium-less powder material 36 is fed from a first hopper 33. Next, the lower movable die 32 is retracted, and a powder material 38 to which indium is added is fed from a second hopper 34. Then an upper movable die 35 with the lead wire 6 being drawn out of the top end thereof is lowered so as to embed the top end of the lead wire 6, then integral molding is effected. In this way, both the commutator side portion and the lead side portion are molded integrally, and at the same time the top end of the lead wire is molded. When the molding is sintered in a reducing atmosphere or the like, the brush 12 is obtained.

Figure 4:
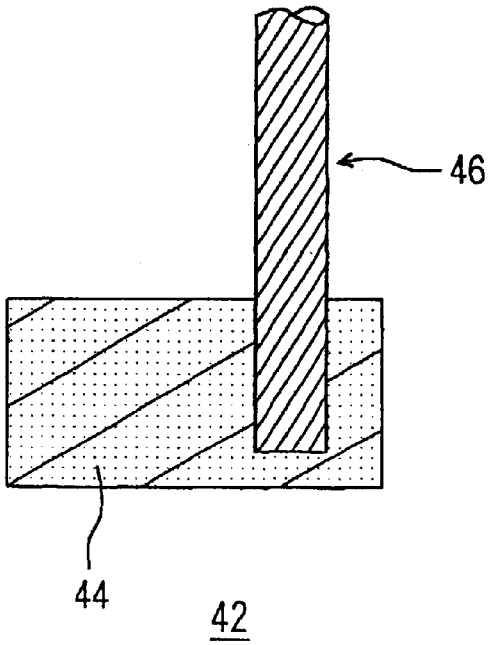
FIG. 4 is a sectional view of a metal-graphite brush of a second modification.
Figure 5:
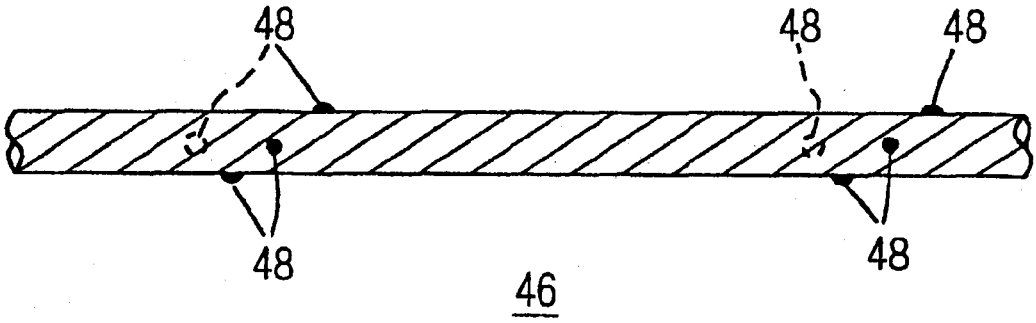
FIG. 5 shows schematically a lead wire which is used in the second modification.

FIG. 4 and FIG. 5 show a second modification. 42 denotes a new metal-graphite brush. No indium is added to the powder material for a brush body 44. A lead wire 46, which is a stranded or braided wire of copper, is spotted with indium solder cream by a dispenser or a head of an ink jet printer. The spots are used as indium sources 48. The indium sources 48 are provided on a portion of the lead wire 46, the portion being to be embedded in the brush body 44. For example, spots are located on the lead wire 46 in the direction of its length at a plurality of points, for example, 3 or 4 points, on its circumference.

The lead wire 46 having the indium sources 48 is used to mold and sinter the brush 42 in the manner similar to that of the conventional brush. In the course of sintering, the solder cream of the Pb sources 48 evaporates or diffuses to coat the surface of the lead wire 46. it also diffuses, through the interface between the lead wire 46 and the brush body, into the metal-graphite of the brush body to coat the surfaces of copper powder in the metal-graphite. In this modification, with a small quantity of indium, the increase in the lead connection resistance can be prevented. As an alternative to this, a copper lead wire or the like, of which portion to be embedded in the brush body is electroplated with indium, may be used. The description of the brush 2 of FIG. 1 also applies to the brush 42 of FIG. 4, if not specified otherwise.

EXAMPLES

In the following, examples for test will be described. The configuration of the brush is one shown in FIG. 1. The height H of the brush body 4 is 13.5 mm, the length L is 13 mm, and the width W is 6.5 mm. The lead wire 6 is a stranded wire of nonelectroplated copper wires. Its diameter is 3.5 mm, and the depth of its embedded portion is 5.5 mm.

(Example 1)

Twenty parts by weight of novolak type phenol resin being dissolved in 40 parts by weight of methanol were mixed with 100 parts by weight of natural flaky graphite. They were mixed up by a mixer homogeneously, and methanol was dried out of the mixture by a drier. The residue was crushed by an impact crusher and sieved with a sieve of 80 mesh pass (a 198 $\mu$m pass sieve) to obtain resin finished graphite powder.

66.5 parts by weight of electrolytic copper, of which mean particle size was 30 $\mu$m, 3 parts by weight of molybdenum disulfide powder and 0.5 part by weight of indium powder were added to 30 parts by weight of the resin finished graphite powder. They were homogeneously mixed by a V type mixer to obtain a powder material. The prepared powder was fed into molds from a hopper, and the powder was molded under the pressure of $4\times10^8$ Pa ($4\times9800$N/cm$^2$) in such a way that the top end of the lead wire 6 is embedded in the molding, and the molding was sintered in a reducing atmosphere in an electric furnace at 700° C. to obtain the brush the example 1.

(Example 2)

62.1 parts by weight of the above mentioned electrolytic copper, 3 parts by weight of molybdenum disulfide powder, and 4.9 part by weight of indium powder were added to 30 parts by weight of the above-mentioned resin finished graphite. The mixture was treated in the same manner as the example 1 regarding other conditions, and a brush of the example 2 was obtained.

(Example 3)

Molybdenum disulfide in the procedure for making the example 1 was substituted by tungsten disulfide, and other conditions were the same as those of the example 1, and a brush of the example 3 was obtained.

(Example 4)

0.3 part by weight of indium and 66.7 parts by weight of electrolytic copper were used in the procedure for the example 1, and other conditions were the same as those of the example 1, and a brush of the example 4 was obtained.

(Example 5)

65 parts by weight of the above mentioned electrolytic copper, 3 parts by weight of molybdenum disulfide and 2 parts by weight of Pb were added to 30 parts by weight of the resin finished graphite which was used in the example 1, and other conditions were the same as those of the example 1, and a brush of the example 5 was obtained. This brush is a conventional leaded brush.

(Example 6)

67 parts by weight of the above mentioned electrolytic copper and 3 parts by weight of molybdenum disulfide were added to 30 parts by weight of the resin finished graphite which was used in the example 1, and other conditions were the same as those of the example 1, and a brush of the example 6 was obtained. This brush is a conventional Pb-less brush.

The composition of the brush after sintering changes a little from the concentrations of the mixed materials because the novolak type phenol resin is partly decomposed and lost at the time of sintering. Table 1 shows the contents of the metal sulfide solid lubricant, Pb and indium in the brushes of the examples 1 through 6. Zero percent (0%) content in Table 1 indicates that the material is at its impurity level.

TABLE 1

Contents of the metal sulfide solid lubricant, Pb and indium

| Sample | Lubricant (%) | Pb (%) | Indium (%) |
|---|---|---|---|
| Example 1 | 3.1 | 0 | 0.5 |
| Example 2 | 3.1 | 0 | 5.0 |
| Example 3 | 3.1 | 0 | 0.5 |
| Example 4 | 3.1 | 0 | 0.3 |
| Example 5 | 3.1 | 2.0 | 0 |
| Example 6 | 3.1 | 0 | 0 |

The brushes of the examples 1 through 6 were put in a constant-temperature & constant-humidity vessel of which temperature was 80° C. and relative humidity was 85% to expose them to the high humidity for 15 days and force copper therein to oxidize, and their lead connection resistances were measured periodically. The changes in the lead connection resistances in the high humidity are shown in Table 2. The number of measurements was ten for each, and the arithmetic mean was used. The measurement of the lead connection resistance was made in accordance with "Method of testing the lead connection resistance of brushes for electrical machines" described in Japan Carbon Associate Standards, JCAS-12-1986. Moreover, the resistivity of each brush body was measured by the four-terminal method, in the direction which is perpendicular to the pressing direction at the time of brush molding. The resistivities of the brush bodies before and after the high-temperature & high-humidity test are shown in Table 3.

TABLE 2

Changes in lead connection resistances resulting from exposure to 80° C. and humidity of 85%

| Sample | Lead connection resistance (unit: mV/10A) | | | | | | | | |
|---|---|---|---|---|---|---|---|---|---|
| Number of days | Initial value | 1 | 2 | 3 | 4 | 5 | 7 | 10 | 15 |
| Example 1 | 0.79 | 0.88 | 1.02 | 1.22 | 1.56 | 1.68 | 1.86 | 1.95 | 2.03 |
| Example 2 | 0.76 | 0.86 | 0.95 | 1.06 | 1.13 | 1.20 | 1.26 | 1.31 | 1.39 |
| Example 3 | 0.80 | 0.89 | 1.06 | 1.31 | 1.61 | 1.73 | 1.91 | 2.01 | 2.22 |
| Example 4 | 0.82 | 1.02 | 1.21 | 1.86 | 2.33 | 2.76 | 3.25 | 4.76 | 4.21 |
| Example 5 | 0.80 | 0.86 | 0.92 | 0.99 | 1.10 | 1.16 | 1.21 | 1.31 | 1.36 |
| Example 6 | 0.81 | 1.06 | 1.22 | 1.96 | 2.78 | 4.55 | 6.99 | 15.63 | 29.33 |

*Examples 5 and 6 are comparative examples.

TABLE 3

Lead connection resistances before and after the exposure to 80° C. and humidity of 85%

| Sample | Brush body resistivity (unit: μΩ/cm) Initial value | After the high temp. & high humidity test |
|---|---|---|
| Example 1 | 49 | 83 |
| Example 2 | 48 | 62 |
| Example 3 | 49 | 86 |
| Example 4 | 49 | 127 |
| Example 5 | 47 | 60 |
| Example 6 | 47 | 262 |

The Pb-less brush of the example 6 showed significant increases in the lead connection resistance and the resistivity of the brush body under high humidity. The temperature of 85° C. and humidity of 85% were the conditions of the accelerated test. However, even at the ordinary temperature, when the brush is exposed to high humidity over a long period, the brush will be oxidized, and the lead connection resistance and the resistivity will rise. In contrast to this, when iridium was added, the increases in the lead connection resistance and the resistivity of the brush body were suppressed. In particular, in the examples 1 through 3 wherein 0.5 wt % or more indium was added, the increases in the lead connection resistance and the brush body resistivity were reduced satisfactorily.

The increase in the lead connection resistance under high humidity can be prevented by adding indium to the mixed powder only near the lead wire's portion to be embedded, or by supplying indium from the lead wire, although these cases were not shown in the examples. In addition to this, Pb-less brushes pose the problem that the lead connection resistance and the brush body resistivity increase at high temperatures. This is caused with a mechanism similar to that of the increase in the lead connection resistance under high humidity. Hence if the increases in the lead connection resistance and the brush body resistivity in high humidity can be prevented, their increases at high temperatures can be prevented as well.

What is claimed is:

1. A metal-graphite brush comprising a copper-graphite brush body to which a metal sulfide solid lubricant is added and a lead embedded in the copper-graphite brush body characterized in that indium is at least added to an interface between said brush body and the lead.

2. A metal-graphite brush of claim 1, characterized in that indium is added in a concentration of 0.4–8 wt % substantially in all over of said brush body.

3. A metal-graphite brush of claim 1, characterized in that indium is added in a neighborhood of the lead in the brush body, and that no indium is added in a neighborhood of a portion of the brush body with which a commutator of a rotational electric armature is to be in contact.

4. A metal-graphite brush of claim 1, characterized in that an indium source is provided at least at a portion of the lead embedded in said brush body so as to supply indium to the interface between the brush body and the lead.

5. A metal-graphite brush of claim 1, characterized in that the metal sulfide solid lubricant is at least a member of a group comprising molybdenum disulfide and tungsten disulfide and that a concentration of the metal sulfide solid lubricant is 1–5 wt %.

6. A metal-graphite brush of claim 1, characterized in that the lead is a non-electroplated copper lead.

* * * * *

UNITED STATES PATENT AND TRADEMARK OFFICE

CERTIFICATE OF CORRECTION

PATENT NO. : 6,700,292 B2
DATED : March 2, 2004
INVENTOR(S) : Takayoshi Otani et al.

It is certified that error appears in the above-identified patent and that said Letters Patent is hereby corrected as shown below:

Column 1,
Line 58, “substantially in all over of said brush body” should read -- substantially all over said brush body --.

Column 2,
Line 53, “substantially in all” should read -- substantially all --.

Column 8,
Line 17, “substantially in all over of said brush body” should read -- substantially all over said brush body --.

Signed and Sealed this

Twenty-third Day of November, 2004

JON W. DUDAS
*Director of the United States Patent and Trademark Office*